US011118419B2

(12) United States Patent
Norbom

(10) Patent No.: US 11,118,419 B2
(45) Date of Patent: Sep. 14, 2021

(54) WELLBORE CONTROL DEVICE

(71) Applicant: ELECTRICAL SUBSEA & DRILLING AS, Straume (NO)

(72) Inventor: Erik Norbom, Hoevik (NO)

(73) Assignee: ELECTRICAL SUBSEA & DRILLING AS, Straume (NO)

( * ) Notice: Subject to any disclaimer, the term of this patent is extended or adjusted under 35 U.S.C. 154(b) by 203 days.

(21) Appl. No.: 16/336,117

(22) PCT Filed: Sep. 22, 2017

(86) PCT No.: PCT/NO2017/050241
§ 371 (c)(1),
(2) Date: Mar. 25, 2019

(87) PCT Pub. No.: WO2018/056836
PCT Pub. Date: Mar. 29, 2018

(65) Prior Publication Data

US 2019/0211644 A1 Jul. 11, 2019

(30) Foreign Application Priority Data

Sep. 26, 2016 (GB) ..... 1616259
Sep. 26, 2016 (GB) ..... 1616264

(51) Int. Cl.
*E21B 33/06* (2006.01)

(52) U.S. Cl.
CPC ..... *E21B 33/063* (2013.01)

(58) Field of Classification Search
CPC ..... E21B 33/063; E21B 33/0355
See application file for complete search history.

(56) References Cited

U.S. PATENT DOCUMENTS

| | | | |
|---|---|---|---|
| 2,632,425 | A | 3/1953 | Grover |
| 3,050,943 | A | 8/1962 | Thorel et al. |
| 3,242,826 | A | 3/1966 | Smith |
| 3,918,478 | A | 11/1975 | Le Rouax |
| 3,941,141 | A | 3/1976 | Robert |
| 4,188,860 | A | 2/1980 | Miller |
| 4,290,577 | A | 9/1981 | Olson |
| 4,305,565 | A | 12/1981 | Abbe |
| 4,519,571 | A | 5/1985 | Jones et al. |

(Continued)

FOREIGN PATENT DOCUMENTS

| | | |
|---|---|---|
| DE | 2 538 640 A1 | 3/1977 |
| EP | 2 588 708 A1 | 5/2013 |

(Continued)

*Primary Examiner* — Shane Bomar
(74) *Attorney, Agent, or Firm* — Norman B. Thot

(57) ABSTRACT

A wellbore control device comprising a housing (1) defining a throughbore (2) for receiving a tubular, a first gate (4) having a first hole (6) and a second gate (3) having a second hole (5), piston rods (12*a*,12*b*) operably connected to the first and second gates (4,5), the first and second gates (3,4) being supported by the housing (1) and movable transverse to the throughbore (2) between an open position and a closed position, wherein the open position the first and second holes (5,6) are aligned with the throughbore (2), and wherein the gates (3,4) in the closed position split an upper portion (2') of the throughbore (2) completely from a lower portion (2") of the throughbore (2).

8 Claims, 13 Drawing Sheets

(56) References Cited

U.S. PATENT DOCUMENTS

| | | | | |
|---|---|---|---|---|
| 4,537,250 | A * | 8/1985 | Troxell, Jr. | E21B 29/08 166/55 |
| 4,601,232 | A | 7/1986 | Troxell, Jr. | |
| 4,612,983 | A | 9/1986 | Karr, Jr. | |
| 4,840,346 | A | 6/1989 | Adnyana et al. | |
| 4,969,390 | A | 11/1990 | Williams, III | |
| 4,969,627 | A | 11/1990 | Williams, III | |
| 4,997,162 | A | 3/1991 | Baker et al. | |
| 5,025,708 | A | 6/1991 | Smith et al. | |
| 5,056,418 | A | 10/1991 | Granger et al. | |
| 6,244,560 | B1 | 6/2001 | Johnson | |
| 8,353,338 | B2 | 1/2013 | Edwards | |
| 2005/0242308 | A1 | 11/2005 | Gaydos | |
| 2009/0077662 | A1 | 3/2009 | Law et al. | |
| 2013/0270466 | A1 | 10/2013 | Edwards | |
| 2014/0264099 | A1* | 9/2014 | Melancon | E21B 33/063 251/1.1 |
| 2016/0108694 | A1 | 4/2016 | Rao et al. | |
| 2016/0138356 | A1 | 5/2016 | Ellison | |
| 2018/0135376 | A1 | 5/2018 | Norbom | |
| 2019/0010777 | A1* | 1/2019 | Douty | E21B 33/063 |
| 2019/0345790 | A1* | 11/2019 | Nault | E21B 33/064 |

FOREIGN PATENT DOCUMENTS

| | | | |
|---|---|---|---|
| GB | 2 166 786 | A | 5/1986 |
| GB | 2 360 804 | A | 10/2001 |
| GB | 2 452 850 | A | 3/2009 |
| JP | 3-279591 | A | 12/1991 |
| WO | WO 2005/106187 | A1 | 11/2005 |
| WO | WO 2012/000098 | A1 | 1/2012 |
| WO | WO 2014/199184 | A2 | 12/2014 |
| WO | WO 2016/189034 | A1 | 12/2016 |

* cited by examiner

WELLBORE CONTROL DEVICE

CROSS REFERENCE TO PRIOR APPLICATIONS

This application is a U.S. National Phase application under 35 U.S.C. § 371 of International Application No. PCT/N02017/050241, filed on Sep. 22, 2017 and which claims benefit to Great Britain Patent Application No. 1616259.6, filed on Sep. 26, 2016 and to Great Britain Patent Application No. 1616264.6 filed on Sep. 26, 2016. The International Application was published in English on Mar. 29, 2018 as WO 2018/056836 A2 under PCT Article 21(2).

FIELD

The present invention relates to wellbore control devices, and more particularly to blow out preventers and related systems for closing a petroleum well also in the presence of tools or conduits, such as a drill string, in the wellbore.

BACKGROUND

In the oil and gas industry, production or exploration wells are typically provided with one or more cutting devices or well bore control devices, such as a blow out preventer or riser control device, for sealing the well bore in the event of an emergency in order to protect personnel and the environment. Conventional wellbore control devices have cutting rams mounted perpendicular to a vertical throughbore. The rams can be activated to sever a tubular, such as a drill string, or other items (e.g., a wireline, coiled tubing string, etc.) disposed in the well and seal the well. The cutting rams move through a horizontal plane and are often driven by in-line piston hydraulic actuators.

Documents which can be useful for understanding the background include US 2016/0108694, U.S. Pat. Nos. 8,353,338, 4,969,390, 2,632,425, 3,050,943, 3,242,826, 3,918,478, 3,941,141, 4,188,860, 4,290,577, 4,305,565, 4,519,571, 4,601,232, 4,840,346, 4,969,627, 5,025,708, and 5,056,418.

Such well bore control devices must withstand extreme conditions, such as high pressures and temperatures, fluids with corrosive properties, particles, contamination and debris flowing into or out of the well, etc. during use. At the same time, being safety-critical equipment, their operational reliability is of critical importance. These, and other, aspects set stringent requirements and demands for the design of such devices. In order that the well can be closed and sealed in an emergency, the wellbore control device must be able to cut anything present in the wellbore, which can, for example, be a drilling tubular, casing, or tools for well intervention. Effective sealing is moreover required against what may be very high wellhead pressures. Since complicated handling and installation procedures may be required to install or retrieve such devices, particularly when used with offshore wells, it is further desirable that the device be as compact and lightweight as possible.

The above information is presented as background information only to help the reader to understand the present invention. No determination and make no assertion is made as to whether any of the above might be applicable as prior art with regard to the present application.

SUMMARY

An aspect of the present invention is to provide an improved wellbore control device and associated systems and methods. An aspect of the present invention is in particular to provide a wellbore control device which provides advantages over known solutions and techniques in relation to the abovementioned or other aspects.

In an embodiment, the present invention provides a wellbore control device which includes a housing which defines a throughbore comprising an upper portion and a lower portion, the throughbore being configured to receive a tubular, a first gate comprising a first hole arranged in a front part of the first gate and a first recess, a second gate comprising a second hole arranged in a front part of the second gate and a second recess, a first piston rod which is operably connected to the first gate, and a second piston rod which is operably connected to the second gate. The first gate and the second gate are each supported by the housing and are configured to be movable transverse to the throughbore between an open position and a closed position so that, in the open position, the first hole and the second hole are aligned with the throughbore, and, in the closed position, the first gate and the second gate split the upper portion of the throughbore completely from the lower portion of the throughbore. The first recess of the first gate is configured to receive the front part of the second gate. The second recess of the second gate is configured to receive the front part of the first gate.

BRIEF DESCRIPTION OF THE DRAWINGS

The present invention is described in greater detail below on the basis of embodiments and of the drawings in which.

DETAILED DESCRIPTION

Figure 1:
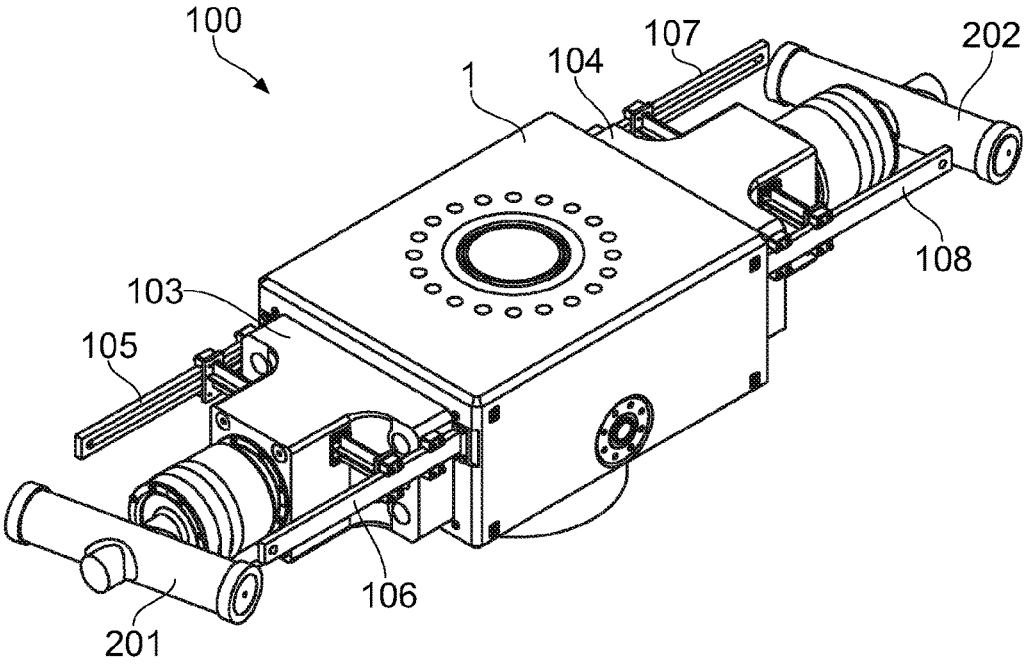
FIG. 1 shows an embodiment of the device which suitable for use, for example, as a wellbore control device.

A first aspect of the present invention provides a wellbore device comprising a housing defining a throughbore, the throughbore adapted to receive a tubular, a first gate having a first hole arranged in a front part of the first gate and a second gate having a second hole arranged in a front part of the second gate and a first piston rod operably connected to the first gate and a second piston rod operably connected to the second gate. The first and second gates being supported by the housing and movable transverse to the throughbore between an open position and a closed position, wherein the open position the first and second holes are aligned with the throughbore, and wherein the gates in the closed position split an upper portion of the throughbore completely from a lower portion of the throughbore. The first gate having a first recess configured to receive the front part of the second gate and the second gate having a second recess configured to receive the front part of the first gate.

In an embodiment, a front wall of the second gate and a front wall of the first gate each follows a curved path in a plane perpendicular to an axis extending longitudinally through the throughbore.

In an embodiment, in the closed position part at least one of said first and second holes remains aligned with the throughbore.

In an embodiment, the first piston rod and the second piston rod are arranged along a common axis.

In an embodiment, at least one of the first gate or the second gate is shaped such that its respective hole is frustoconical or has a frustoconical portion.

A second aspect of the present invention provides a gate assembly having a first gate and a second gate. The having a front part and a rear part, the second gate having a front part and a rear part. A first hole arranged in the front part of the first gate and a second hole arranged in the front part of the second gate. The first gate having a first recess configured to receive the front part of the second gate, and the second gate having a second recess configured to receive the front part of the first gate.

In an embodiment, the second recess comprises a first side wall and a second side wall, the first and second side walls being configured to guide a first side wall and a second side wall of the front part of the first gate.

In an embodiment, the first recess comprises a third side wall and a fourth side wall, the third and fourth side walls being configured to guide a first side wall and a second side wall of the front part of the second gate.

In an embodiment, the first recess comprises a first rear wall, the first rear wall configured to abut a front wall of the second gate.

In an embodiment, the first rear wall follows a curved path in a plane perpendicular to an axis extending longitudinally through the throughbore.

In an embodiment, the first rear wall follows a semicircular shape.

In an embodiment, the second recess comprises a second rear wall, the second rear wall configured to abut a front wall of the first gate.

In an embodiment, the second rear wall follows a curved path in the plane perpendicular to the axis extending longitudinally through the throughbore.

In an embodiment, the second rear wall follows a semicircular shape.

In an embodiment, the gateway assembly comprising seals arranged to provide a substantially fluid-tight seal between the housing and the first and second gates and between the first and second gates when the gates are in the closed position. The seals are non-metallic or elastomeric.

A third aspect of the present invention provides a cutting device for use with a wellhead, comprising a housing defining a throughbore, a first gate having a first hole and a second gate having a second hole. The first gate and the second gate being mounted within the housing and movable transversely with respect to the throughbore between an open position and a closed position, wherein in the open position the first and second holes encompass the throughbore. The first piston and a first piston rod operably connected to the first gate with a first stroke length (x), a second piston and a second piston rod operably connected to the second gate with a second stroke length, the first and second stroke length being less than a diameter of the throughbore. The first gate having a first recess configured to receive the front part of the second gate and the second gate having a second recess configured to receive the front part of the first gate.

In an embodiment, a front wall of the second gate and a front wall of the first gate each follows a curved path in a plane perpendicular to an axis extending longitudinally through the throughbore.

In an embodiment, in the closed position part at least one of said first and second holes remains aligned with the throughbore.

In an embodiment, the first piston rod and the second piston rod are arranged along a common axis.

In an embodiment, at least one of the first gate or the second gate is shaped such that its respective hole is frustoconical or has a frustoconical portion.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. Also, the various embodiments described herein are not necessarily mutually exclusive, as some embodiments can be combined with one or more other embodiments to form new embodiments.

Reference is now made to the drawings, and more particularly to FIGS. 1-19, where various embodiments are shown.

FIGS. 1-6 and 19 show a device 100 according to an embodiment, suitable for use as e.g., a wellbore control device, cutting device or a blow-out preventer in a subsea or surface wellhead system. The device comprises a housing 1 having a throughbore 2. A first gate 4 and a second gate 3 are arranged in the housing and adapted to move transversely and in different (in this example opposite) directions in relation to the throughbore 2. The gates 3 and 4 have respective holes 5 and 6 (see FIG. 2). In the open position (FIG. 4), the holes 5 and 6 overlap and are aligned substantially co-axially with the throughbore 2 to permit passage through the throughbore, for example of a tubular holding drilling tools (e.g., a drill string) or a wireline carrying well intervention equipment. In the closed position (FIG. 6), the gates 3 and 4 are moved so that holes 5 and 6 do not overlap and the gates 3 and 4 split the throughbore into an upper portion and a completely separate lower portion, thus closing the throughbore.

Figure 2:
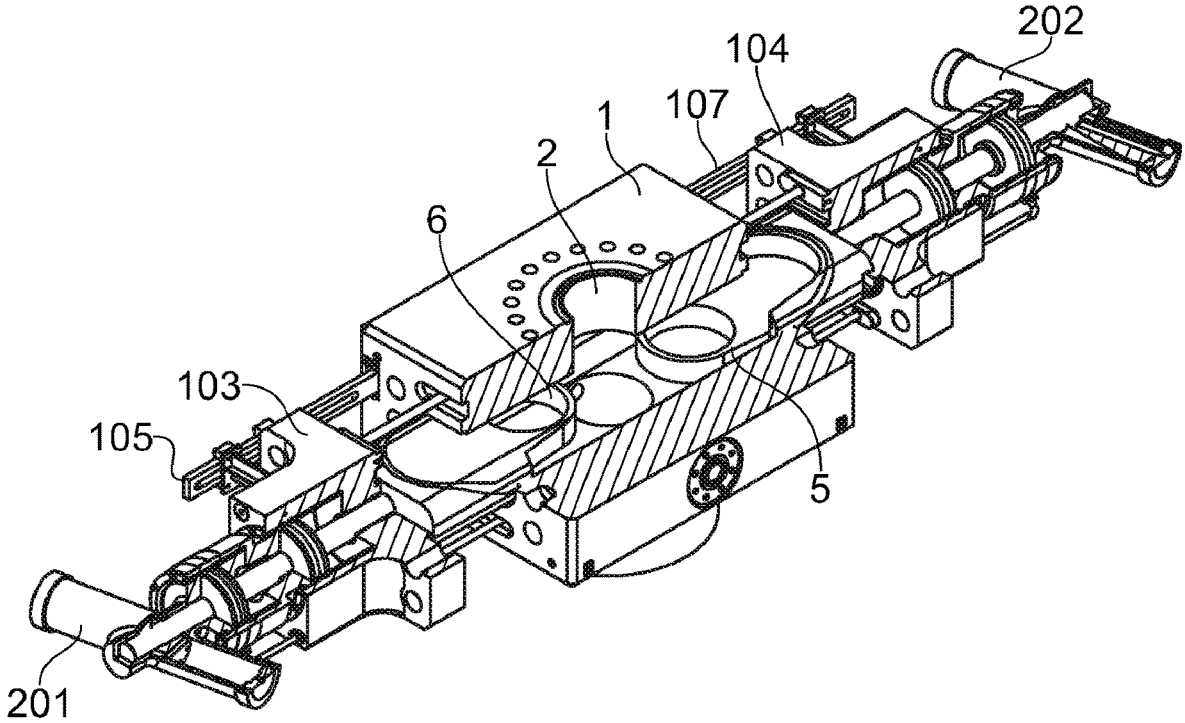
FIG. 2 shows a partially disassembled view of the device of FIG. 1.

FIG. 1 shows the device 100 in an operational configuration and FIG. 2 shows a partially disassembled view of the device 100. A first bonnet 103 and a second bonnet 104 are fixed to the housing 1. The bonnets 103 and 104 can be released from the housing 1 and moved away from the housing 1 along rails 105-108. This permits maintenance and repairs to be carried out, for example replacement of the gates 3 and 4. The bonnets 103 and 104 also comprise hydraulic actuators, as will be described in further detail below.

Rod locking apparatuses 201 and 202 are provided and configured to lock the gates 3 and 4 in the locked position, in a manner which will be described in further detail below.

The first gate 4 and the second gate 3 define a shearing face between them, such that upon movement from the open position to the closed position, a tubular (or other equipment) located in the throughbore 2 will be sheared by the edges of holes 5 and 6. The shearing edges of holes 5 and 6 may be provided with a hardened surface compared to the rest of the gate body, e.g., by means of hardened cutting-edge inserts (shown as item 75 and 76 in FIG. 16). For example, an MP35 material or equivalent may be suitable for this purpose.

In the closed position (FIG. 6), holes 5 and 6 are left in a position where each hole 5 or 6 remains in communication to the throughbore 2. This is achieved by arranging the end ("closed") position of the gates 3 and 4 at a position where the sections of the gates 3 and 4 comprising the holes are not moved fully out of the throughbore 2 and thus not moved completely into the housing 1. Alternatively, the wellbore control device can be arranged so that only one of the holes 5 and 6 or part of one of the holes 5, 6 remain aligned with the throughbore 2, for example hole 6 in the upper gate 4, whereas hole 5 in the lower gate 3 is moved fully into the housing 1.

Figure 3:
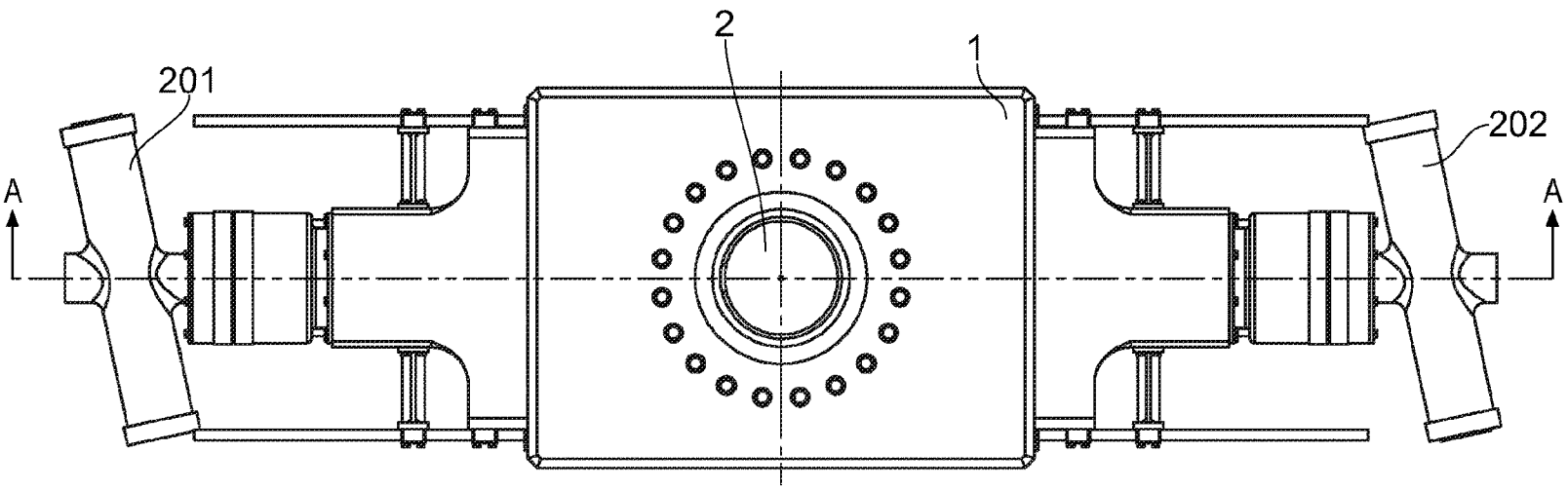
FIG. 3 shows a top view of the device shown in FIG. 1.

FIG. 3 shows a top view of the device shown in FIG. 1.

Figure 4:
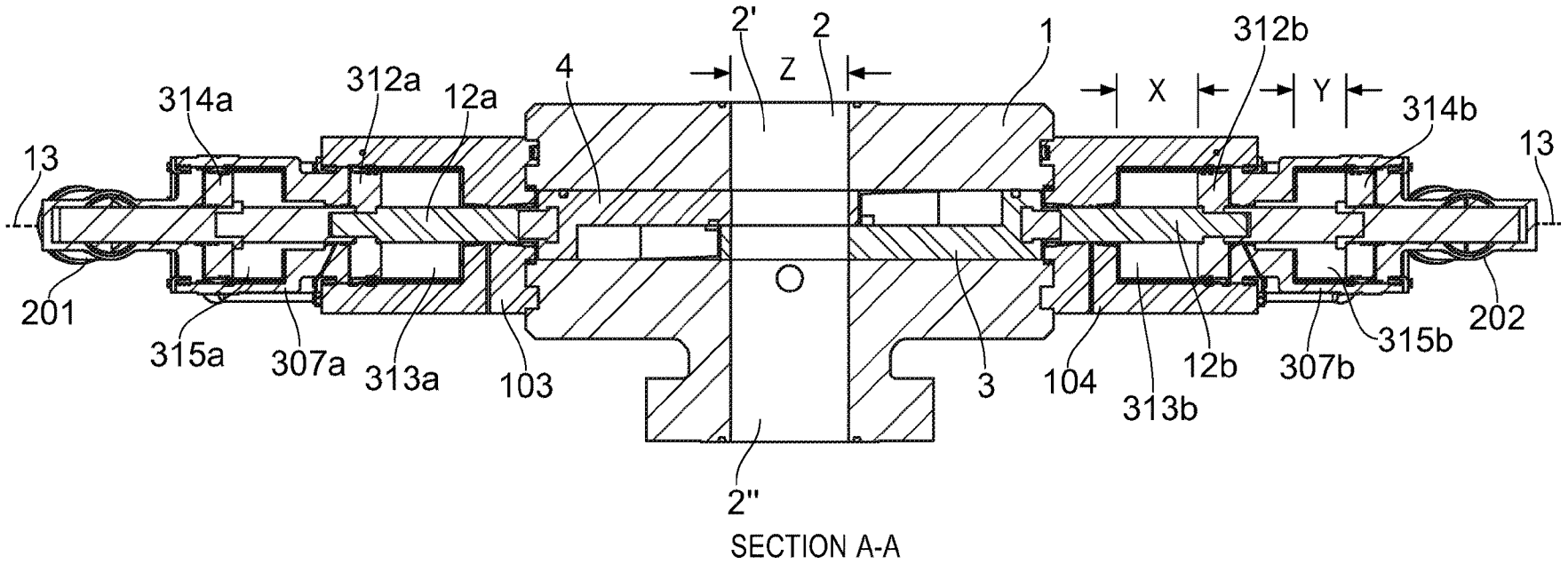
FIG. 4 shows a sectional view of the device of FIG. 1 in the open position.

FIG. 4 shows a side cut view (section A-A as indicated in FIG. 3) of the device 100 in an open position.

Figure 5:
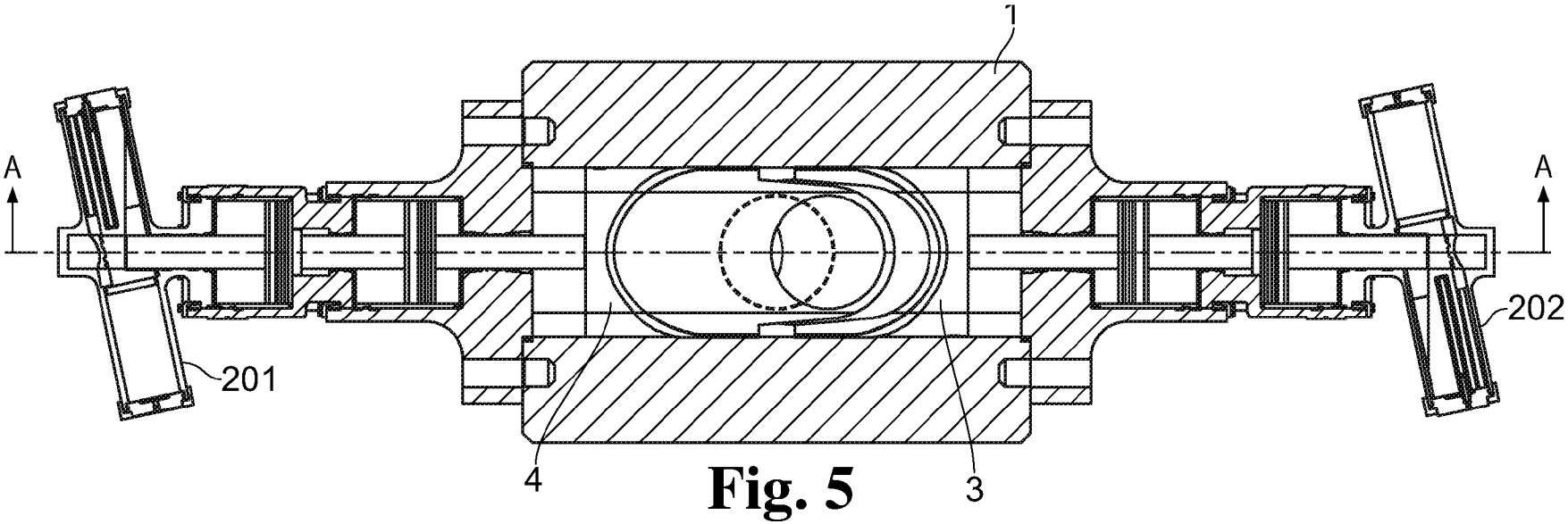
FIG. 5 shows a sectional view of the device of FIG. 1 with the gates near the fully closed position.
Figure 6:
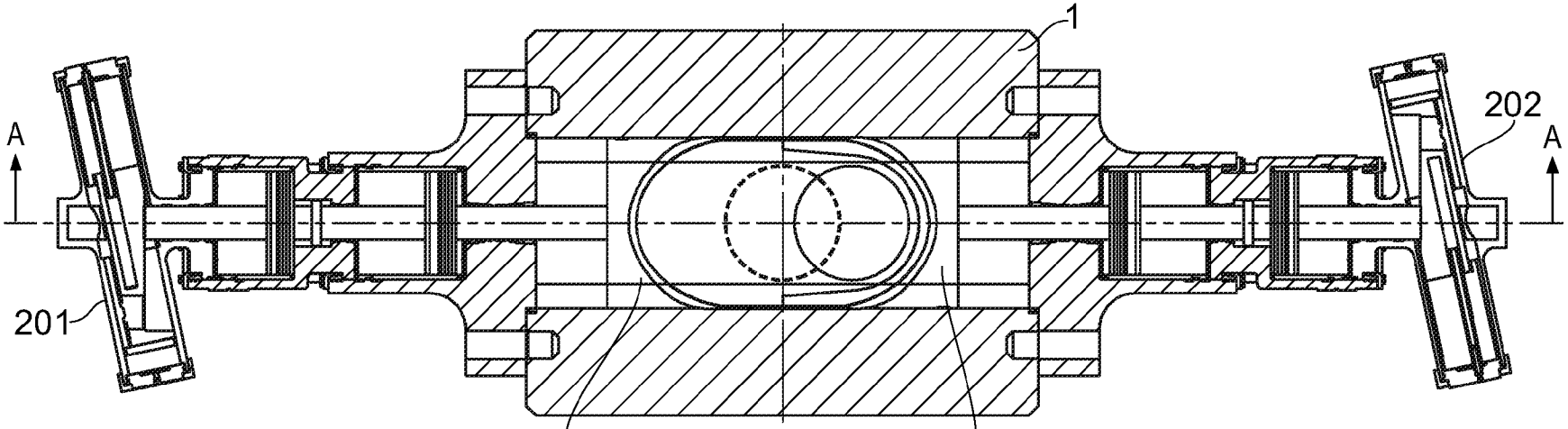
FIG. 6 shows a sectional view of the device of FIG. 1 with the gates in the fully closed position.

FIGS. 5 and 6 show a top, partially cut view of the device 100. FIG. 5 shows the gates 3 and 4 near the fully closed position and FIG. 6 shows the gates 3 and 4 in the fully closed position.

Referring now to FIG. 4, a first piston rod 12*a* is operably connected to the first gate 4 and a second piston rod 12*b* is operably connected to the second gate 3. The first and second gates 3 and 4 are supported by the housing 1 and movable transverse to the throughbore 2 between an open position and a closed position. In the open position the holes 5 and 6 are aligned with the throughbore 2 and/or encompass the throughbore 2. In the closed position the gates 3 and 4 split an upper portion 2' of the throughbore 2 completely from a lower portion 2" of the throughbore 2.

The rods 12*a* and 12*b* in this embodiment here are made up of individual segments connected together, however may equally well be formed in one piece as a single piece.

A first actuator piston 312*a*, operating in a first actuator cylinder 313*a*, and a first piston rod 12*a* are operably connected to the first gate 4. The first actuator piston 312*a* has a first stroke length. A second actuator piston 312*b*, operating in a second actuator cylinder 313*b*, and a second piston rod 12*b* are operably connected to the second gate 3. The second actuator piston 312*b* has a second stroke length x. (See FIG. 4.). The first stroke length is, in this embodiment, identical to the second stroke length x, however in other embodiments this need not necessarily be the case. The first and second stroke lengths x are less than a diameter z of the throughbore 2.

The first piston rod 12*b* and the second piston rod 12*b* are arranged along a common axis 13.

In use, movement of the gates 3,4 from the open position to the closed position will thus shear (sever) an object such as a tubular located in the throughbore 2. Advantageously, permitting part of one or both of the first and second holes 5,6 to remain in alignment with the throughbore 2 in the closed position allows a part of the cut object, such as a tubular, to remain in the hole after cutting, thus it is not necessary to do a "double cut", or to have a mechanism for lifting the cut object out of the hole, as would be required for the gate to move fully into the housing in the closed position. Such lifting of a drilling tubular may be extremely challenging, as a tubular may extend over several hundred meters from a topside facility and the total weight may be several hundred tons. A double cut would require cutting also the tubular between the gate 3 or 4 and the housing 1.

A further advantage of this embodiment is that gates 3, 4, as opposed to conventional rams, are fully supported for loads around the throughbore 2. Once an object, such as a drill string, has been cut, or even during cutting, its full weight will rest on, and have to be carried by, the gates 3, 4. The same will be the case if the object is in compression or tension, which may equally create very high vertical loads on the cutting elements. By having gates 3, 4 which are supported by the housing 1, any bending of the gates due to forces from the cut object, or splitting/separation of the gates due to cutting loads acting at the shearing point between the gates, is avoided. Thus, in the case of e.g., a BOP system, the gates will be supported for vertical loads during the entire cutting and sealing position, both from above and below.

By providing the first and second gates 3, 4 with first and second holes 5, 6 which are aligned substantially co-axially with the throughbore 2 in the open position allows the device 100 to be designed with a through passage essentially without snag points. The holes 5, 6 can be designed essentially flush with the throughbore 2 walls.

In this embodiment, due to the use of gates with holes compared to conventional cutting rams, the tubular (e.g., drilling pipe) will be forced to the center of in the throughbore 2 upon cutting, thus there will be no risk of the cutting elements not being able to "catch" and engage the tubular. This can be a problem if e.g., the drilling pipe is forced to one side of the throughbore 2 by tension or weight forces.

As is most clearly seen from FIG. 4, the gates 3 and 4 are actuated by means of hydraulic actuators arranged in relation to the bonnets 103 and 104. The actuators comprise hydraulically driven piston-cylinder arrangements. The gates 3 and 4 are actuated by pistons 312*a* and 312*b* operable in cylinders 313*a* and 313*b*, respectively, and by pistons 314*a* and 314*b* operating within cylinders 315*a* and 315*b*, respectively. The cylinders 315*a* and 315*b* are arranged in tandem actuators 307*a* and 307*b*, each fixed to a respective bonnet 103 or 104.

Figure 14:
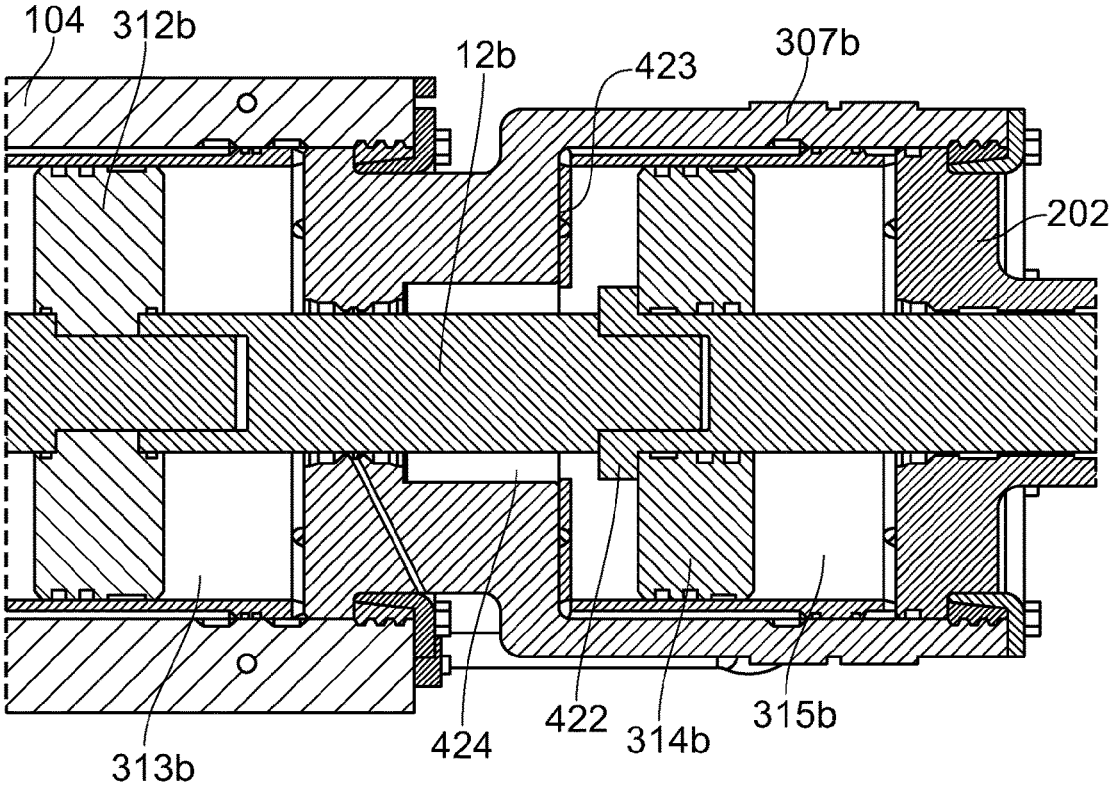
FIG. 14 shows details of an actuator unit.

FIG. 14 show further details of the actuators and the tandem actuators. The bonnet 104 has a cylinder 313*b* arranged in the bonnet 104, with a respective piston 312*b*. A tandem actuator 307*b* is provided in conjunction with the bonnet 104. The tandem actuator 307*b* also has a cylinder 315*b* and respective piston 314*b*. The tandem actuator 307*b* is secured to the bonnet 104 by means of an attachment device, for example a latch ring and a locking ring, as can be seen in FIG. 14. The locking apparatus 202 is attached in an equivalent manner to the tandem actuator 307*b*.

The second piston rod 12*b* extends out of the housing 1 and into the bonnet 104. The second piston rod 12*b* is connected to the piston 312*b* and extends further into the tandem actuator 307*b*. The tail end of the second piston rod 12*b* extends into the locking device 202, and the locking device 202 may be operated to engage the tail end and to prevent movement of the tail end when the device is in the closed position (see FIGS. 4 and 6).

The piston 314*b* of the tandem actuator 307*b* is a floating piston 314*b* which is slidably arranged on the second piston rod 12*b*. The second piston rod 12*b* comprises a mechanical stop 422. The mechanical stop 422 may be a shoulder on the second piston rod 12*b*. When the back side (right hand side in FIG. 15) of the floating piston 314*b* is pressurized in cylinder 315*b*, the floating piston 314*b* will be urged towards the mechanical stop 422 and thus contribute to actuating the gate via the second piston rod 12*b*.

The floating piston 314*b* may have a shorter stroke length than the piston 312*b*. This improves the compactness of the overall unit. For example, when cutting an object located in the throughbore 2, such as a drill string, with the gates 3 and 4, the highest force requirements will be during the cutting process. After the cut has been done, the final movement of the gates may be merely to fully close the gates 3 and 4 and actuate the seals. This final movement requires much less actuation force.

By providing the floating piston 314*b* with a shorter stroke length than the piston 312*b*, the floating piston 314*b* may contribute actuation force for part of the stroke, while not consuming hydraulic fluid during the rest of the actuation stroke (for example during the final movement as noted above). This can be achieved by designing the cylinder 315*b* such that the floating piston 314*b* is stopped against an end stop 423 within the cylinder after a pre-determined stroke length for the floating piston 314*b*.

The cylinder 315*b* may be provided with a recess 424 being adapted for receiving the mechanical stop 422 during part of the stroke length of the actuator. This allows the end stop for the floating piston 314*b* to be the end 423 of the cylinder 315*b*, while the second piston rod 12*b* with the mechanical stop 422 may continue its motion over the final part of the actuation stroke as the floating piston 314*b* stops at the end 423 of the cylinder 315*b*, while the second piston rod 12*b* can continue its motion, sliding along within the floating piston 314*b*. FIG. 5 shows the position during the stroke at which the floating piston 314*b* has reached the end stop 423, while FIG. 6 illustrates how the piston 312*b* continues the actuation stroke to bring the gates into the fully closed position with the floating piston at its end stroke position. This allows the cylinder 315*b* to be designed with a length substantially equal to the stroke length of the floating piston 314*b*, thus allowing for a shorter and more compact tandem actuator 307*b*.

This moreover may provide advantages in relation to the operation of the device in certain embodiments. Since, in some embodiments, the sealing between the housing 1 and the gates 3 and 4 may be designed to be energized only upon nearly full or full closure of the valves (see below), it may be desirable to maintain a closing force from the actuators in order to keep the seals energized. By providing an actuator design according to some of the embodiments described above, it will be possible to maintain a closing force from piston 312*b* by keeping cylinder 313*b* pressurized, however while avoiding having to employ the full closing/shearing force of the device for this (relatively less demanding) purpose. This may improve system lifetime and energy usage.

The actuator arrangement on the opposite side, i.e., in relation to gate 4 and bonnet 103, is designed and operates equivalently.

Figure 7:
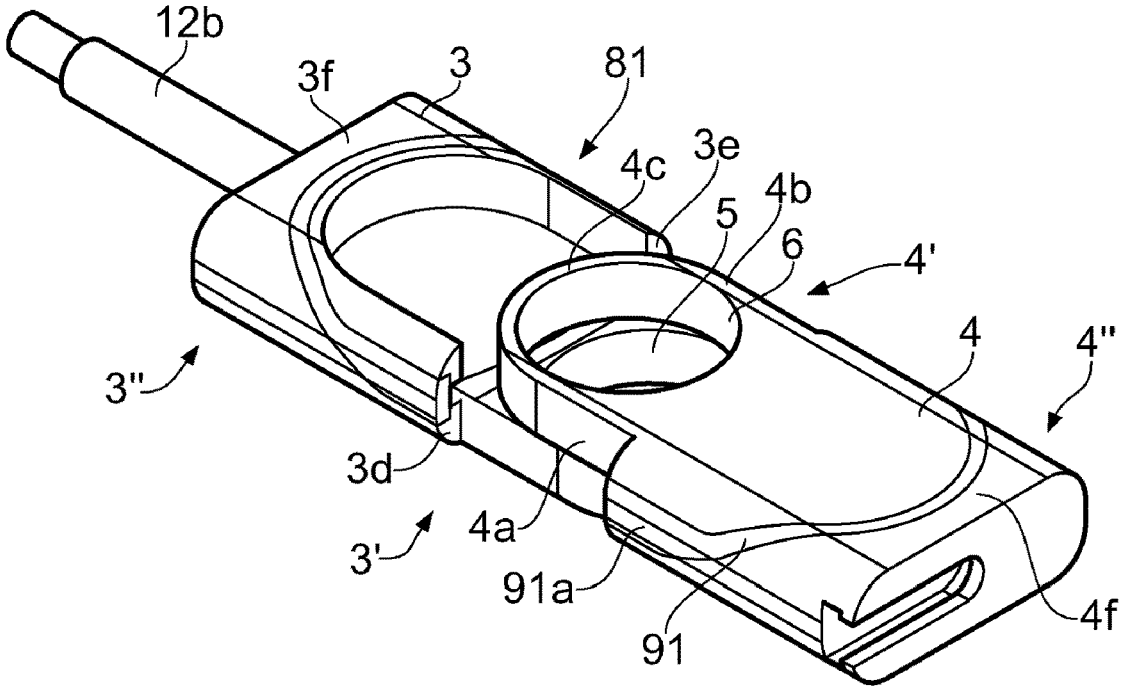
FIG. 7 shows a gate assembly for use in a device shown in FIGS. 1-6.

FIGS. 7-13 show further details of the gates 3 and 4 and associated components, according to one embodiment. FIG. 7 shows a gate assembly for use in a device as described above, the gate assembly comprising a first gate 4 and a second gate 3. The first gate 4 has a front part 4' and a rear part 4", and the second gate 3 has a front part 3' and a rear part 3". The first hole 6 is arranged in the front part 4' of the first gate 4, and the second hole 5 is arranged in the front part 3' of the second gate 3. The front parts 3' and 4' protrudes from the rear parts 3" and 4" forwardly as seen in the direction of travel when the respective gate 3 or 4 moves from the open position to the closed position.

Figure 8:
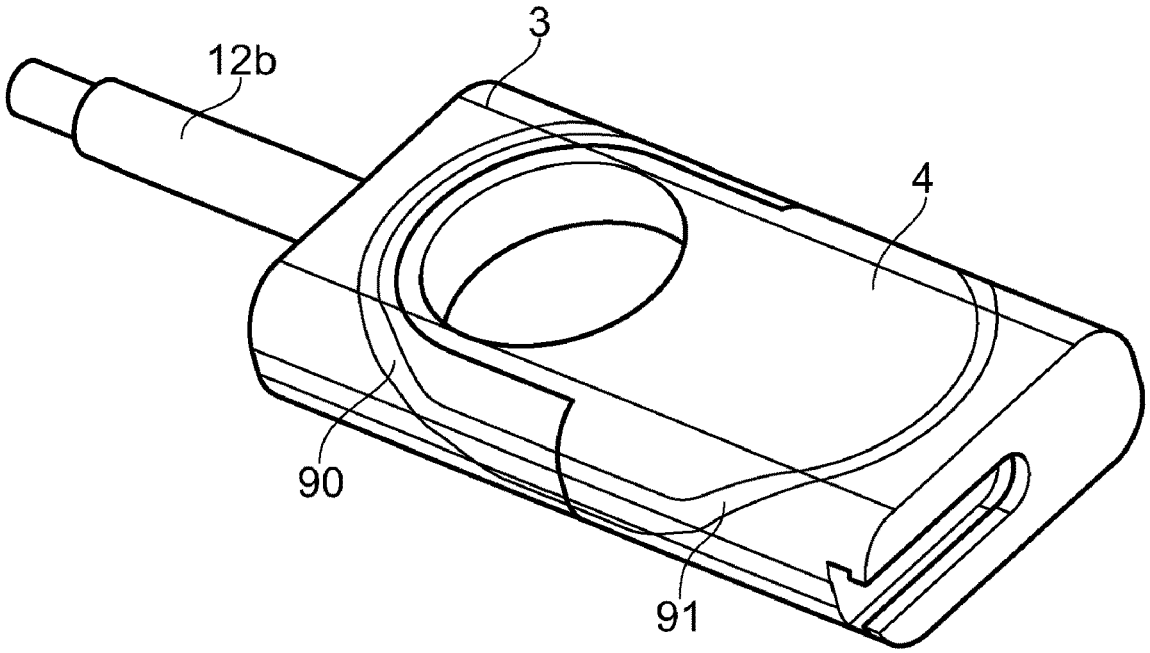
FIG. 8 shows the gate assembly of FIG. 7 in a closed position.
Figure 9:
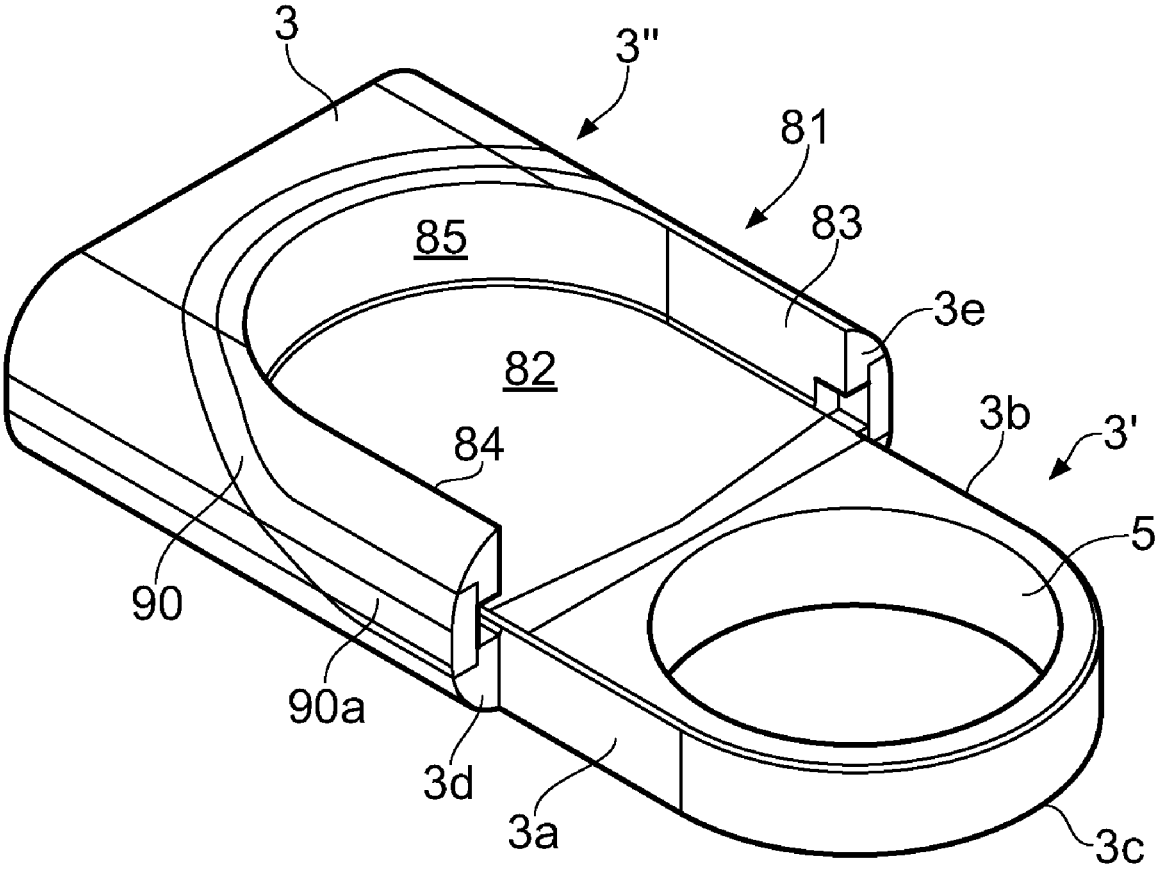
FIG. 9 shows a top perspective view of the second gate with a seal.
Figure 10:
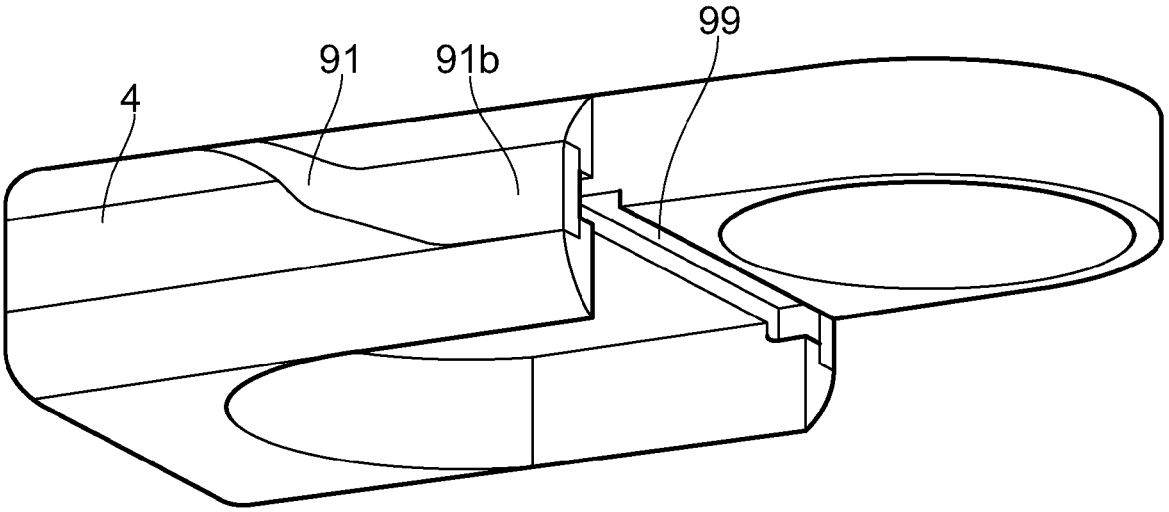
FIG. 10 shows a bottom perspective view of the first gate with a seal groove.
Figure 11:
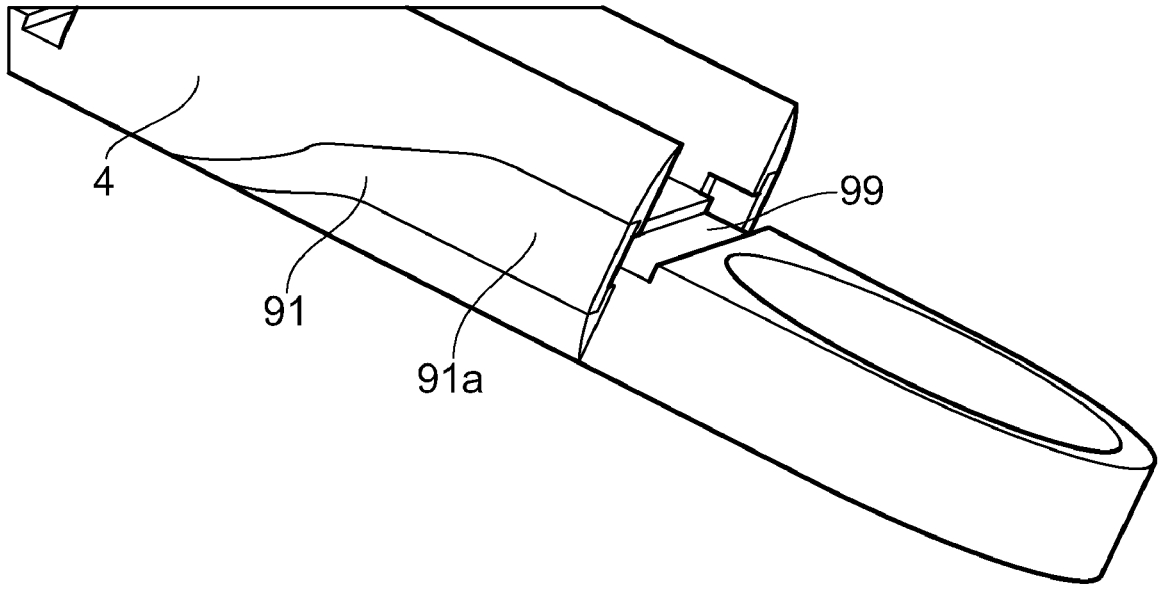
FIG. 11 shows a top, side perspective view of the first gate with a seal groove.
Figure 12:
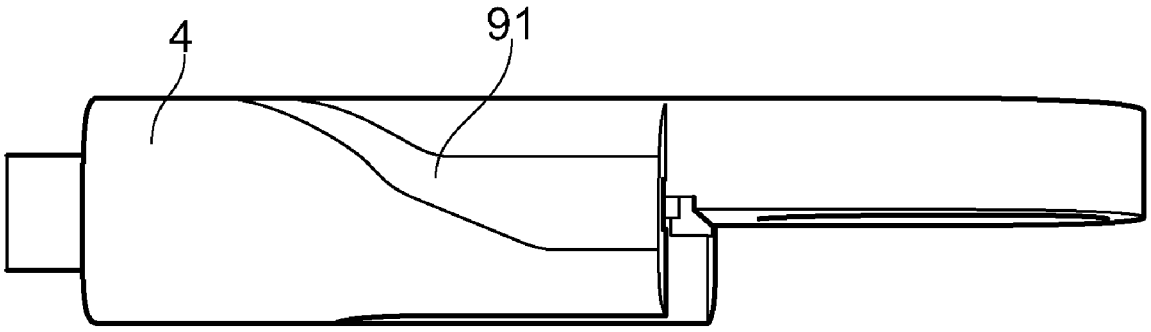
FIG. 12 shows a side view of the first gate with a seal.
Figure 13:
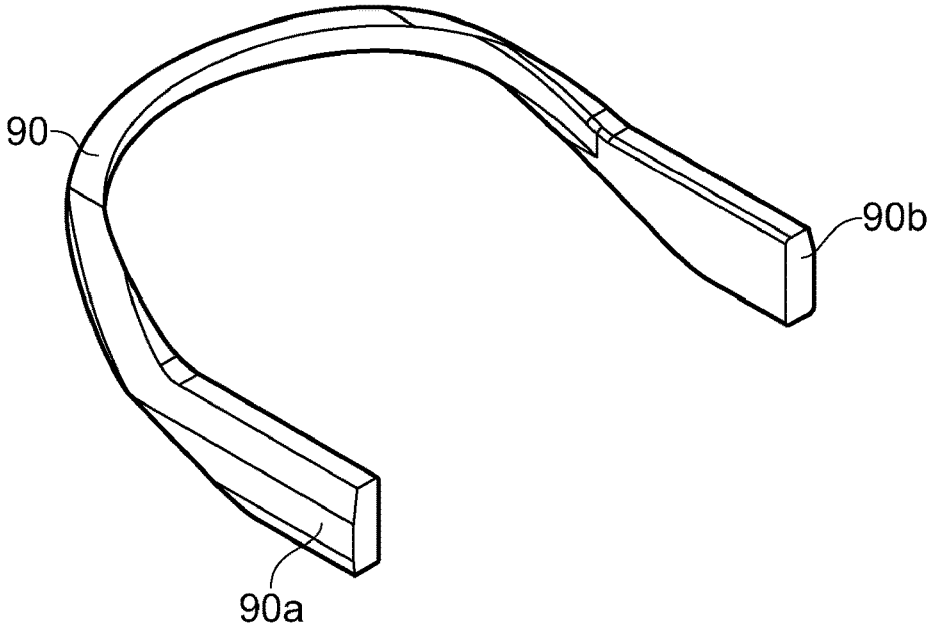
FIG. 13 shows a top perspective view of the seal and the side packer seals of the second gate.

The second gate 3 has a recess 81 configured to receive the front part 4' of the first gate 4, and the first gate 4 has a recess configured to receive the front part 3' of the second gate 3. The recess 81 is adapted to receive the entire front part 4' of the first gate 4, or part of the front part 4' of the first gate 4, when the gate assembly is in the closed position, as illustrated in FIG. 8. The recess of the first gate 4 is designed equivalently as the recess 81 of the second gate 3. Providing a recess in each of the gates 3 and 4 enables a compact design of the gate assembly, and thus allowing a more compact overall device.

The recess 81 comprises a first side wall 83 and a second side wall 84. The first and second side walls 83 and 84 are configured to guide a first side wall 4*a* and a second side wall 4*b* of the front part 4' of the first gate 4 during the movement of the gate assembly from the open position to the closed position. The recess of the first valve may have equivalent side walls to guide side walls of the front part 3' of the second gate 3. This assists the gate assembly in achieving a clean cut and to perform well also in difficult operating conditions, for example if the device has to cut a tool joint, since each of the gates 3 and 4 will have additional support during the movement from the other gate.

The recess 81 may further comprise a rear wall 85, where the rear wall 85 may, if desirable, be configured to about a front wall 4*c* of the front part 4' of the first gate 4 in the closed position. In this embodiment, the rear wall 85 follows a curved path in an imaginary plane perpendicular to an imaginary axis extending longitudinally through the hole 5, 6, i.e., an axis extending along the throughbore 2. The recess of the first gate 4 may have an equivalent a rear wall, which may be configured to abut a front wall 3*c* of the front part 3' of the second gate 3. The rear wall of the first gate 4 may also follow a curved path, equivalently as for the second gate 3. The curved path may have a semi-circular shape.

The front wall 3*c* of the second gate 3 and the front wall 4*c* of the first gate 4 equivalently follow a curved path in the imaginary plane perpendicular to an imaginary axis extending through the hole. This path may also be semi-circular. This allows a compact gate assembly, while maintaining a high structural strength of the front parts 3' and 4' (particularly around the hole 5 and 6) and of the rear parts 3" and 4".

The recess 81 and the recess of the first gate 4 can be machined into the respective gate 3,4, for example by extrusion or milling. The side walls are preferably rigid, such as to provide good sideways support for the other gate. In an embodiment, each gate 3,4 can be made of a single piece of material in which the respective hole 5,6 and recess 81 is formed. This provides good structural stability of the gate 3,4. The material is preferably a metal.

As can be seen in FIGS. 7-12, the second gate 3 comprises a seal 90 and the first gate 4 comprises a seal 91. The seal 90 is provided in a seal groove on the second gate 3 and the seal 91 is provided in a seal groove on the first gate 4. The seal groove extends in a continuous manner from a front end 3*d* of the back part 3" of the second gate 3, across a top side 3*f* of the second gate 3, and to the front end 3*e* on the other side of the second gate 3. The seal 91 is arranged equivalently on the first gate 4. The seals 90 and 91 are arranged to provide a substantially fluid-tight seal between the housing 1 and the first and second gates when the gates 3 and 4 are in the closed position.

The seals are preferably non-metallic, for example elastomeric or polymeric seals. The seals 90 and 91 each comprise side packer seals 90*a*, 90*b*, 91*a* and 91*b*. The seals 90 and 91 are energized by means of the side packer seals upon the first and second gates reaching the closed position. In that position, the side packer seals 90*a* and 91*a* come together and the side packer seals 90*b* and 91*b* come together. The side packer seals thus seal against each other and energize all seals.

A seal groove 99 (see FIGS. 10-12) is provided on at least one of the gates 3 or 4 (in this embodiment, on the first gate 4), the seal groove 99 having a gate seal (not shown in the drawings but arranged in the seal groove 99) configured to seal between the gates 3 and 4 when the gates 3 and 4 are in the closed position. The seal groove 99 extends towards the sides of the first gate 4 such that the gate seal is in communication with the side packer seals 90*a*, 90*b*, 91*a* and 91*b*. The seal groove 99 is preferably on the underside of the upper gate (in this embodiment, first gate 4), to engage with an upwards-facing surface of the lower gate (in this embodiment, second gate 3). This avoids a cut item, such as a pipe end 21*a* (see FIG. 17) whose weight is carried by the lower gate (in this embodiment, second gate 3) to damage the gate seal.

The gate seal is energized by means of the side packer seals 90*a*, 90*b*, 91*a* and 91*b* upon the first and second gates reaching the closed position: The second gate 3 comprises second side packer seals 90*a* and 90*b* and the first gate 4 comprises first side packer seals 91*a* and 91*b*, the first and second side packer seals being configured to come into contact in the closed position such as to engage each other and be pressed together, thereby energizing the seals 90 and 91 by compression. Due to the seals' elastic properties, the side packer seals coming together will thus energize all seals. Since the seal groove 99 is in communication with the side packer seals, this will include energizing the gate seal.

The side packer seals provide a substantially fluid-tight seal between the gates 3, 4 and the housing 1, to prevent flow of fluid between the gates 3, 4 and the housing 1. The gate seal provides a substantially fluid-tight seal between the two gates 3, 4, when the gates 3, 4 are in the closed position. As a result, when the gates 3, 4 are in the closed position, fluid flow along the throughbore 2 is substantially prevented.

Providing an elastomeric seal which is energised upon closing provides the advantage that the seals are protected in the seal groove prior to engagement, thus will not be damaged by external objects. This is particularly important for the gate seal, where e.g., the cut pipe end may have sharp edges which could destroy the seal. A further advantage can be realised by providing the seal groove for the gate seal in a curved shape. This further reduces the risk that external object present in the throughbore 2 enters the seal groove and damages the seal.

Providing non-metallic seals, such as elastomeric or polymeric seals, gives improved sealing in the closed position. A particular challenge in, for example, BOPs, is that the shearing faces and surfaces are damaged during cutting. This may particularly be the case where the full weight of a drill string acts on a surface, and slides across it during closing. This may render conventional metal-to-metal seals ineffective, i.e., the device may not be able to seal the wellbore completely off in a critical situation. Non-metallic seals are significantly more tolerant to such damaged and uneven surfaces, providing more effective sealing.

Energizing of the seals only upon closing further permits the seals to be positioned in seal grooves, wherein they are protected against any object being cut in the wellbore. Upon full, or near full, closure of the device, the seals can be energized, and thus engage the relevant face to be sealed against, e.g., a housing surface or a surface on the other gate.

Forming a seal groove on a gate in a semi-circular shape prevents any cut objects from extending into the seal groove. In particular, when cutting a tubular, the cut end will be deformed into an oval, and in particular cases, a nearly flat shape. Sliding such a cut end across a surface with a seal groove may lead to it being pushed into the seal groove and thus damaging the seal. By providing a semi-circular seal groove the cut end finds support on other parts of the gate surface at any point when sliding across a seal groove.

Figure 15:
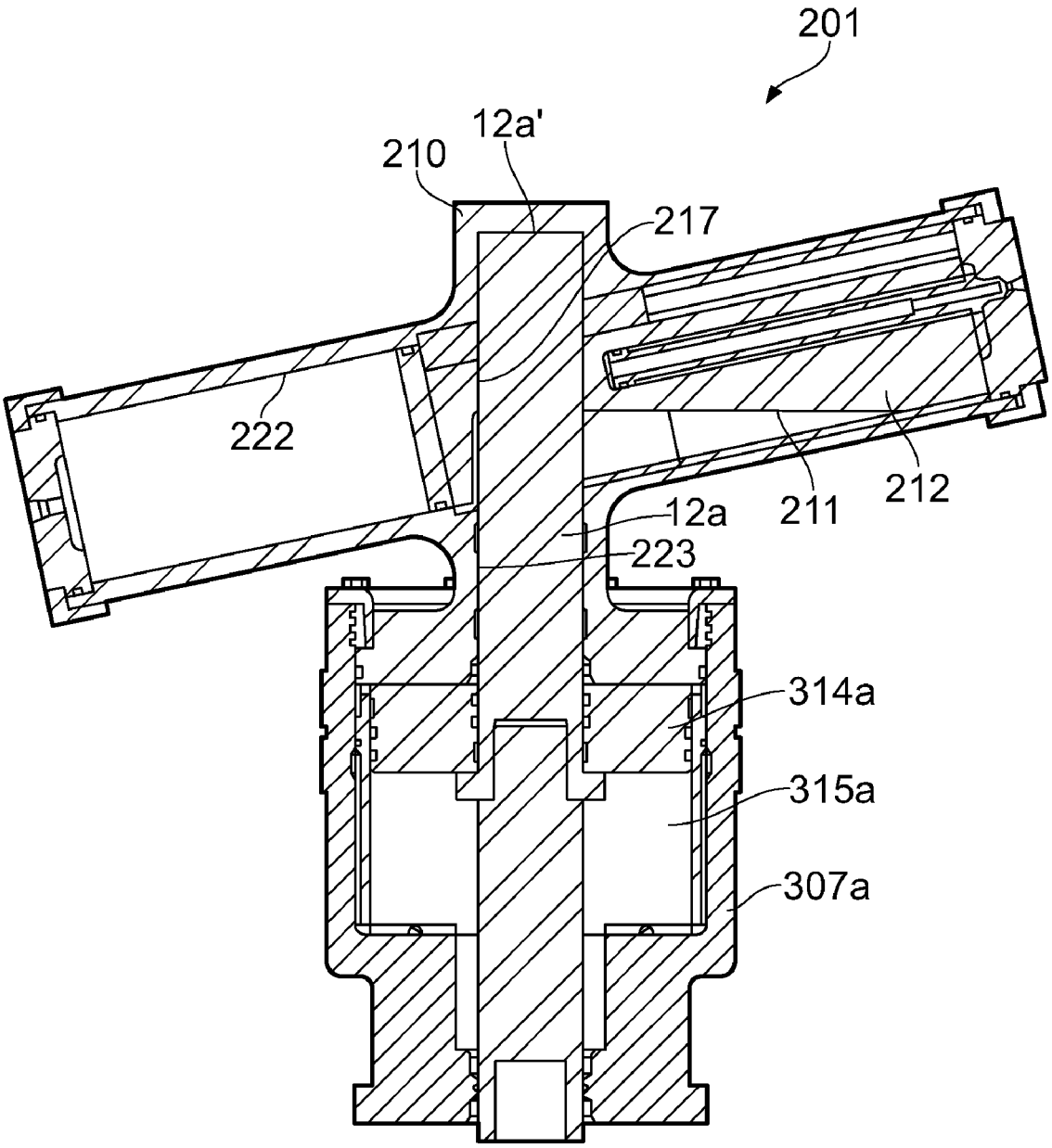
FIG. 15 shows a rod locking apparatus.

FIG. 15 illustrates further details of the rod locking apparatuses 201 and 202. (Apparatus 201 is shown, however apparatus 202 operates equivalently.) Each rod locking apparatus 201 and 202 comprises a main housing 210 having a first tubular passage 222 and a second tubular passage 223. The housing 210 is provided with a mounting attachment to attach the locking apparatus to the bonnets 103 and 104 or to the tandem actuator as illustrated in FIGS. 5, 6 and 14 and described above.

A wedge piston 212 is slidably provided in the housing 210. The wedge piston 212 has a front side with a wedge surface 211 which engages a back end surface 12*a*' of the first piston rod 12*a*. The wedge piston 212 is movable between a closed position in which it substantially blocks the second tubular passage 223 and an open position in which the second tubular passage 223 is open.

Figure 19:
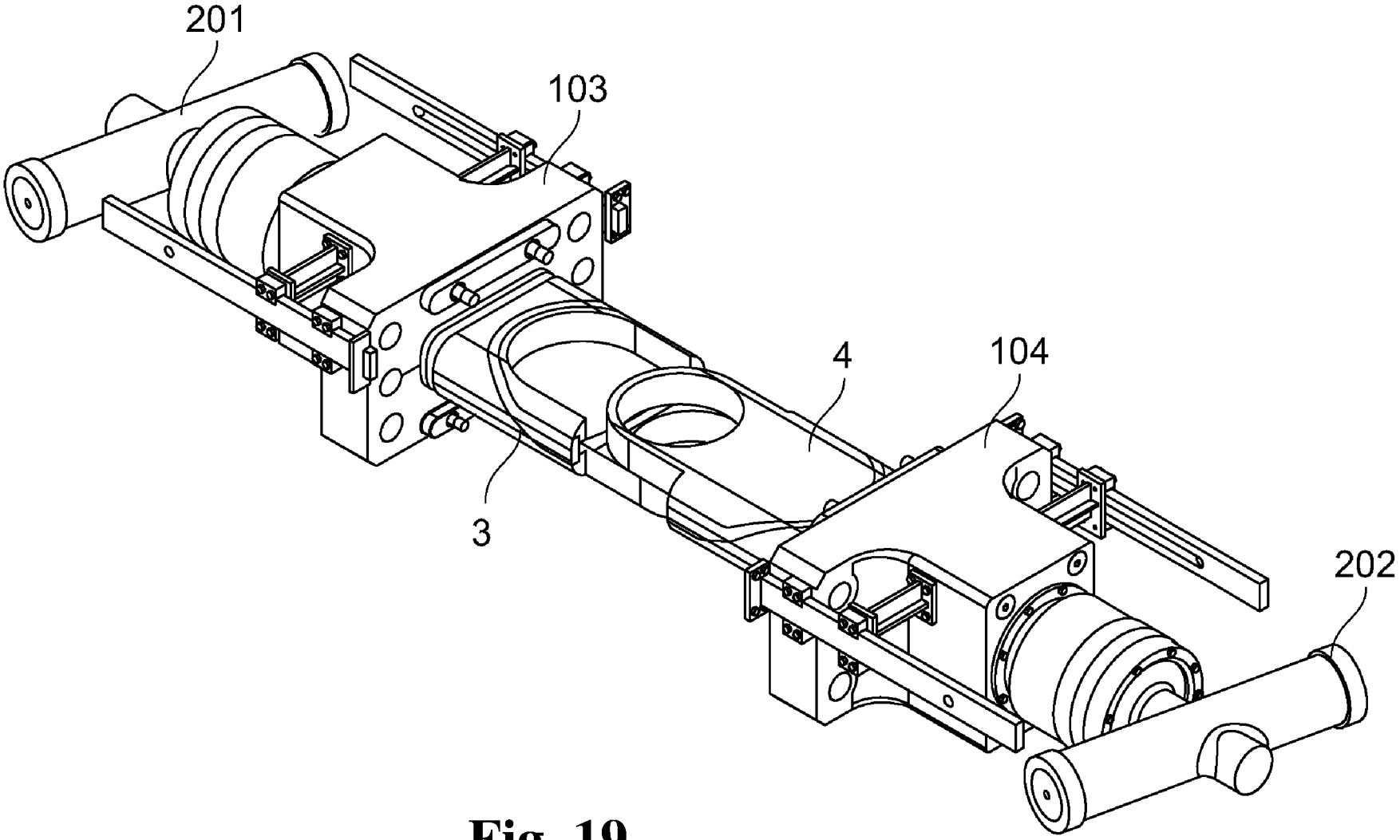
FIG. 19 shows further details of the device shown in FIGS. 1-6.

In this example, the wedge piston 212 has a transverse bore forming a through passage 217 which extends from the front side to the rear side of the wedge piston 212 generally parallel to the second tubular passage 223 and, when the wedge piston 221 is in the open position, is aligned with the second tubular passage 223 so that the rod 12*a* may extend through the through passage 217 as shown in FIG. 19. (See also FIG. 4.) When the wedge piston 212 is in the closed position, the through passage 217 is not aligned with the second tubular passage 223, as illustrated in FIG. 6.

The wedge piston 212 incorporates a series of ridges, or teeth, that mesh with grooves in a serrated locking surface arranged on the back end surface 12*a*' or in the main housing 210. The design of the serrations may be according to one of the alternatives described in U.S. Pat. No. 4,969,390 or any other suitable design. This may include splines, grooves, ridges, or teeth, or a combination thereof, suitable for producing a mating motion and a friction-based locking effect between the wedge piston 212 and the serrated locking surface.

Figure 16:
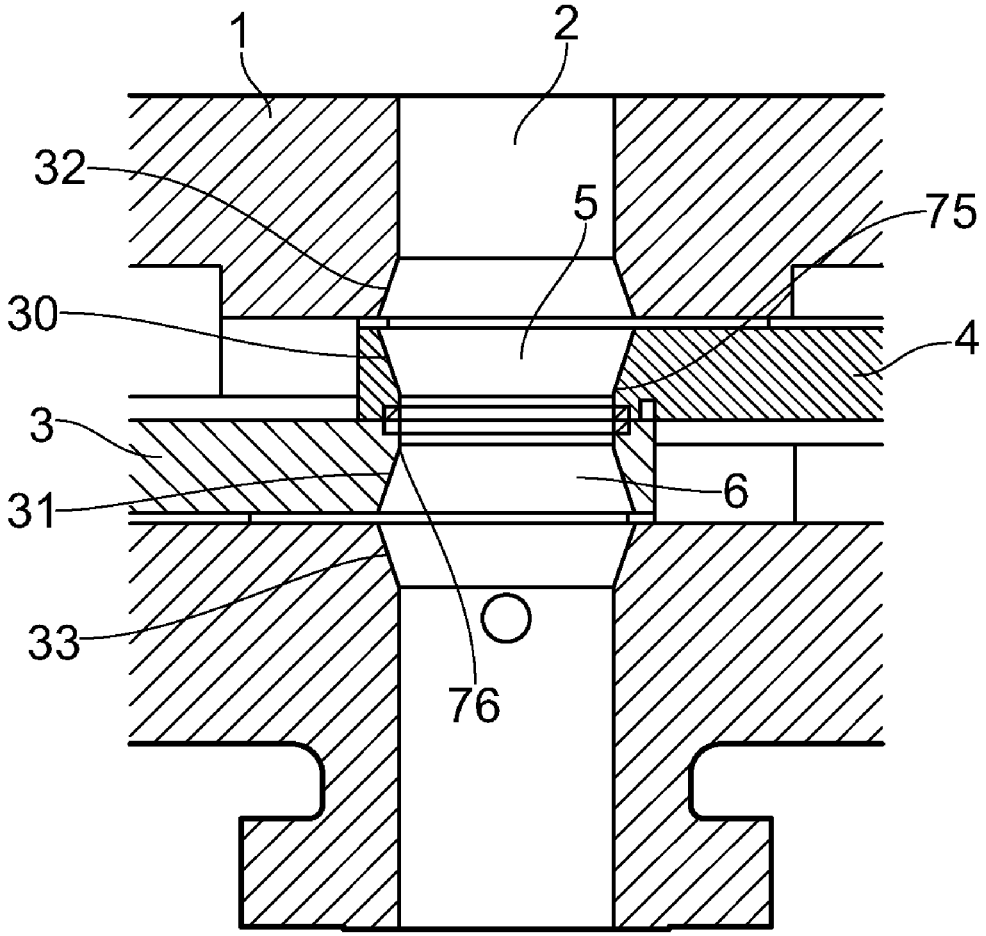
FIG. 16 shows a magnified view of an embodiment where the first gate and the second gate are shaped so that their respective hole has a frustoconical portion.
Figure 17:
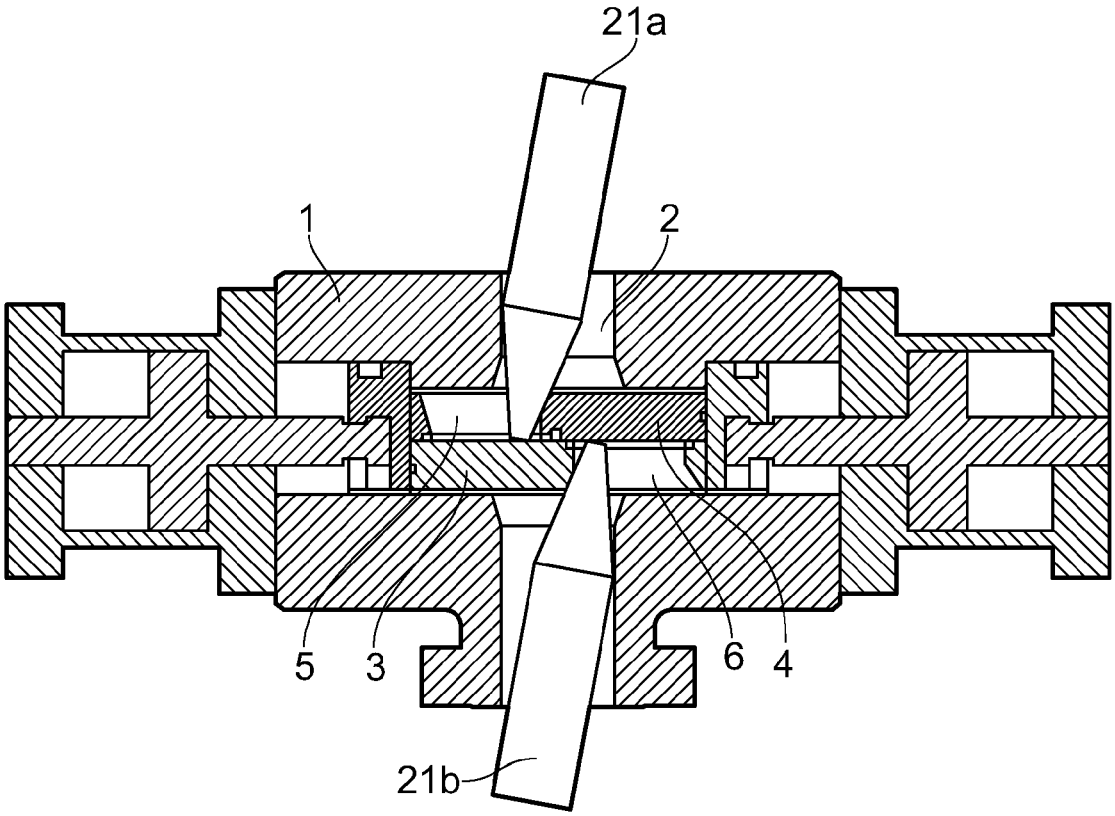
FIG. 17 shows an embodiment where the first gate and the second gate are shaped so that their respective hole has a frustoconical portion but with pipe ends inserted in the hole.
Figure 18:
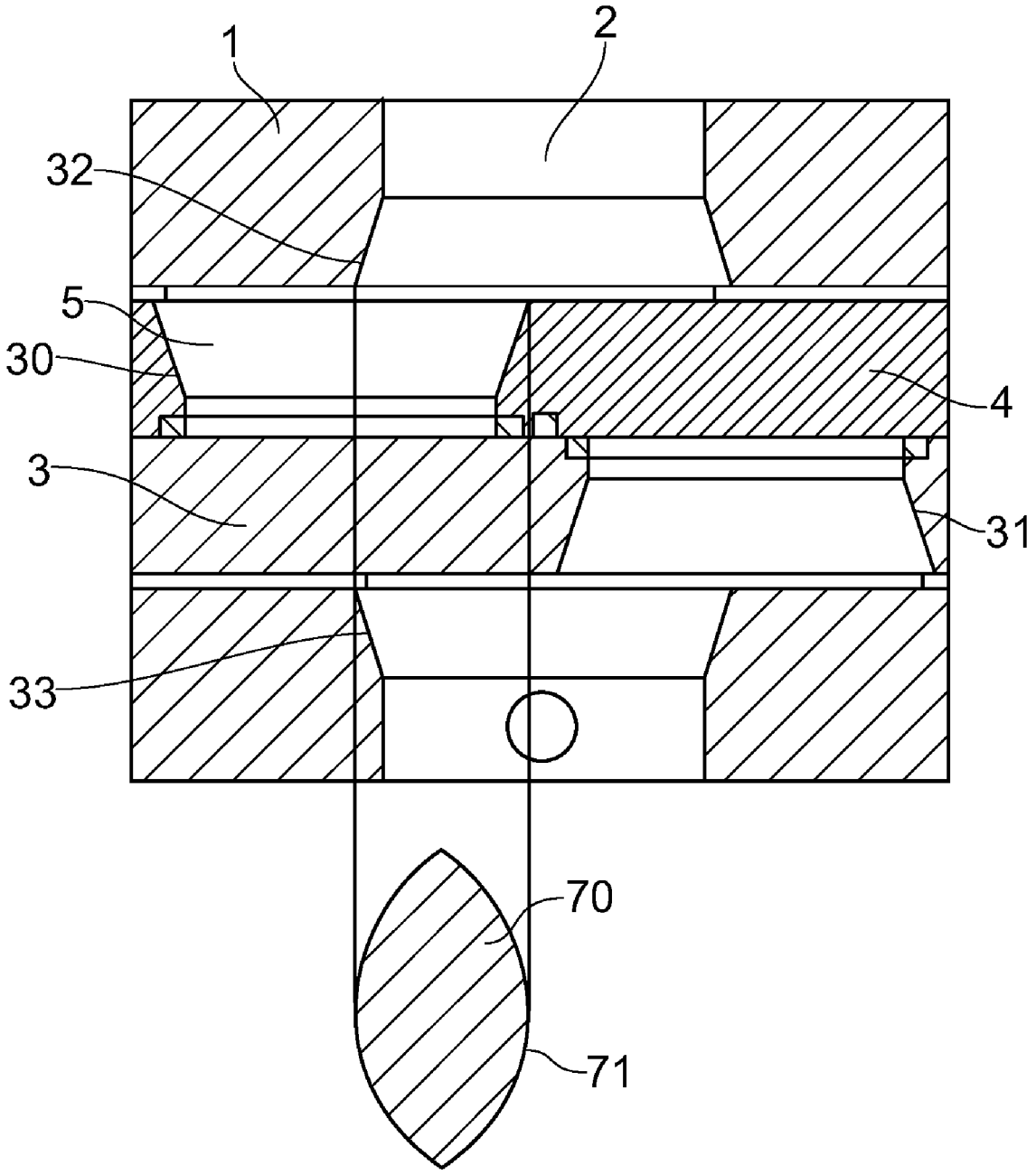
FIG. 18 shows the area interconnecting the hole of the second gate and the throughbore in a closed position.

FIGS. 16-18 illustrate further details of one embodiment. In this embodiment, the second gate 3 and the first gate 4 are shaped such that its respective hole 5 and 6 is frustoconical or has a frustoconical portion 30 and 31. The diameter of the hole 5 and 6 is larger towards the side of the gate 3 and 4 facing the housing 1 and smaller towards the side of the gate 3 and 4 adjacent to the other gate.

Optionally, the housing 1 is shaped such that the throughbore 2 has frustoconical portions 32 and 33. As can be seen in FIGS. 16 and 18, the housing 1 is shaped such that the throughbore 2 has two frustoconical portions 32 and 33 which are arranged such that the gates 3 and 4 are directly adjacent to and supported between the two frustoconical portions 32 and 33 of the throughbore 2.

The frustoconical portions 32 and 33 of the throughbore 2 has a larger diameter end and a smaller diameter end, and is arranged with the larger diameter end directly adjacent one of the two gates 3 and 4 and the smaller diameter end spaced from the gates 3 and 4.

FIG. 16 shows this in a magnified view. In this embodiment, a part of one or both holes 5 and 6 has a frusto-conical portion 30, 31, whereby the diameter of the holes 5 and/or 6 is larger towards the side facing the housing 1 compared to that facing the other gate. The frustoconical portions 30 and 31 provide the additional advantage that more space is available for the end of the cut object, e.g., pipe ends 21*a* and 21*b* (see FIG. 17) in the hole 5 or 6 when the wellbore device is in the closed position.

Further, the throughbore 2 can be provided with frustoconical portions 32 and/or 33 at a point interfacing the gates 3 and 4. The frustoconical portions 32 and/or 33, on their own or in combination with the frusto-conical portions 30 and 31, provide the same advantages as those described above, i.e., allowing more space for the cut object in the holes 5 and 6 after closure of the device. Frustoconical portions 30, 31, 32 and 33 thus provide particular advantages if there is a need to cut large-diameter objects, e.g., a casing tubular, as there will be less tendency for the cut pipe end to be deformed when present in the hole 5 or 6 during closing of the gates 3 and 4.

FIG. 17 illustrates in a schematic manner two cut ends 21*a* and 21*b* of a tubular which was present in the throughbore 2 prior to closing and has been sheared by gates 3 and 4. The cut ends of the tubular 21*a* and 21*b* are left in holes 5 and 6 when the wellbore control device is in the closed position. This eliminates the need for pipe ends 21*a* and 21*b* to be lifted, removed or subject to a "double cut", i.e., shearing between the upper edge of hole 5/lower edge of hole 6 and the housing 1, which would have been necessary if the gates 3 and 4 were to be driven fully into the housing 1.

This configuration may also allow the device to shear a large-diameter tubular object, such as a casing string. In this case, the pipe ends 21*a* and 21*b* will be deformed, but as in the case above, remain partly in the holes 5 and 6.

FIG. 18 illustrates the area 70 interconnecting the hole 5 of gate 3 and the throughbore 2 in the closed position. (A similar area will exist for the lower gate 4.) With a circular hole 5 this area 70 will have the shape of a circle intersection, or vesica piscis. The area 70 will have a circumferential length 71. In an embodiment, the frustoconical portions 30 and 32 are arranged with an appropriate conical angle (i.e., the angle between the frusto-conical portions 30 and 32 to the vertical) such at the circumference length 71 is larger than the circumference of the largest tubular object to be sheared by the device.

As noted above, when cutting a tubular, the cut end will be deformed, generally into an oval-like shape. Arranging frustoconical portions 30 and 32 with a conical angle large enough to give such a circumferential length 71 in a vesica piscis shaped area allows the cut end to remain in the hole 5 without the need for a double cut or further deformation of the tubular.

For example, in conventional wellbore systems the throughbore 2 may have a diameter of 18¾" (47.6 cm). For cutting of object larger than 6⅝" (16.8 cm) OD, the frustoconical portions can form an increased circumferential length 71 which can allow for cutting and sideways storage of objects up to 14" (35.6 cm) OD. The objects will be deformed to the circumference and the available shape and space. Thus, the wellbore control device according to the present invention is, unlike conventional systems, able to cut and seal with various sized tubular present in the throughbore.

Advantageously, providing conical portions in the gates and/or in the throughbore therefore allows more space for the cut object to remain in the hole after closing. Particularly, if cutting a large-diameter tubular, such as casing, the cut end may be heavily deformed, usually into an oval shape. Providing conical portions allows such a deformed end to remain in the hole without affecting the closing function of the device.

By providing frustoconical portions of the same dimensions in both the gates and the throughbore, a substantially flush through passage can be achieved through the device, thus avoiding any snag points in the open position.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the present invention in diverse forms thereof.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of various embodiments, those skilled in the art will recognize that the embodiments herein can be practiced with modification within the spirit and scope of the embodiments as described herein.

The present invention is not limited to the embodiments described herein. Reference should be had to the appended claims.

What is claimed is:

1. A wellbore control device comprising:

a housing which defines a throughbore comprising an upper portion and a lower portion, the throughbore being configured to receive a tubular;

a first gate comprising a first hole arranged in a front part of the first gate and a first recess;

a second gate comprising a second hole arranged in a front part of the second gate and a second recess;

a first piston rod which is operably connected to the first gate; and a second piston rod which is operably connected to the second gate;

wherein, the first gate and the second gate are each supported by the housing and are configured to be movable transverse to the throughbore between an open position and a closed position so that, in the open position, the first hole and the second hole are aligned with the throughbore, and, in the closed position, the first gate and the second gate split the upper portion of the throughbore completely from the lower portion of the throughbore, the first recess of the first gate is configured to receive the front part of the second gate, the second recess of the second gate is configured to receive the front part of the first gate, the first gate further comprises a front wall, the second gate further comprises a front wall, and the front wall of the first gate and the front wall of the second gate each follow a curved path in a plane which is perpendicular to an axis extending longitudinally through the throughbore.

2. The wellbore control device as recited in claim 1, wherein, in the closed position, at least a part of at least one of the first hole and the second holes is aligned with the throughbore.

3. The wellbore control device as recited in claim 1, wherein the first piston rod and the second piston rod are arranged along a common axis.

4. The wellbore control device as recited in claim 1, wherein at least one of the first hole and the second hole has a frustoconical shape or comprises a frustoconical portion.

5. A wellbore control device comprising:

a housing which defines a throughbore comprising an upper portion and a lower portion, the throughbore being configured to receive a tubular;

a first gate comprising a first hole arranged in a front part of the first gate and a first recess;

a second gate comprising a second hole arranged in a front part of the second gate and a second recess;

a first piston rod which is operably connected to the first gate; and a second piston rod which is operably connected to the second gate;

wherein, the first gate and the second gate are each supported by the housing and are configured to be movable transverse to the throughbore between an open position and a closed position so that, in the open position, the first hole and the second hole are aligned with the throughbore, and, in the closed position, the first gate and the second gate split the upper portion of the throughbore completely from the lower portion of the throughbore, the first recess of the first gate is configured to receive the front part of the second gate, the second recess of the second gate is configured to receive the front part of the first gate, and in the closed position, at least a part of at least one of the first hole and the second holes is aligned with the throughbore.

6. The wellbore control device as recited in claim 5, wherein, the first gate further comprises a front wall, the second gate further comprises a front wall, and the front wall of the first gate and the front wall of the second gate each follow a curved path in a plane which is perpendicular to an axis extending longitudinally through the throughbore.

7. The wellbore control device as recited in claim 5, wherein the first piston rod and the second piston rod are arranged along a common axis.

8. The wellbore control device as recited in claim 5, wherein at least one of the first hole and the second hole has a frustoconical shape or comprises a frustoconical portion.

* * * * *